US009617095B1

(12) United States Patent
Curley et al.

(10) Patent No.: US 9,617,095 B1
(45) Date of Patent: Apr. 11, 2017

(54) SPOOL AND SPINDLE GUIDE SYSTEM

(71) Applicant: Goss International Americas, Inc., Durham, NH (US)

(72) Inventors: Richard D. Curley, Dover, NH (US); Gary Cooper, Raymond, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 15/130,359

(22) Filed: Apr. 15, 2016

(51) Int. Cl.
*B65H 5/32* (2006.01)

(52) U.S. Cl.
CPC ..... *B65H 5/32* (2013.01); *B65H 2301/436* (2013.01); *B65H 2301/4382* (2013.01); *B65H 2301/516* (2013.01); *B65H 2301/5161* (2013.01)

(58) Field of Classification Search
CPC ..... B65H 5/32; B65H 2301/4382; B65H 2301/516; B65H 2301/5161; B65H 37/04; B65H 2301/436
USPC ..... 198/644; 270/52.18, 52.22, 52.26; 271/175
See application file for complete search history.

(56) References Cited

U.S. PATENT DOCUMENTS

| | | | | |
|---|---|---|---|---|
| 4,260,145 | A | 4/1981 | Mebus et al. | |
| 4,482,141 | A | 11/1984 | Moser | |
| 4,519,599 | A * | 5/1985 | Mayer | B42B 2/02 270/52.18 |
| 5,116,033 | A * | 5/1992 | Honegger | B65H 39/02 270/52.2 |
| 5,772,195 | A | 6/1998 | Mueller | |
| 2003/0047857 | A1* | 3/2003 | Peier | B65H 5/32 270/52.16 |
| 2005/0225023 | A1 | 10/2005 | Schlough | |
| 2007/0228633 | A1* | 10/2007 | Hoffmann | B42B 9/02 270/52.25 |
| 2013/0277906 | A1* | 10/2013 | Arendt | B42B 2/00 270/37 |
| 2015/0008635 | A1* | 1/2015 | Tsunoda | B42C 1/12 270/52.18 |
| 2015/0065324 | A1* | 3/2015 | Hattori | B42C 19/08 493/416 |

* cited by examiner

*Primary Examiner* — David H Bollinger
(74) *Attorney, Agent, or Firm* — Davidson, Davidson & Kappel, LLC

(57) ABSTRACT

A saddle stitcher is provided. The saddle stitcher includes a saddle conveyor for transporting signatures and at least one signature guide located along the saddle conveyor. The signature guide includes a plurality of supports and at least one flexible member supported by the plurality of supports thereby defining a guide area. The at least one flexible member guides the signature in the guide area. Methods are also provided.

20 Claims, 8 Drawing Sheets

SPOOL AND SPINDLE GUIDE SYSTEM

The present invention relates generally to printing presses and more particularly to saddle conveyors, saddle binders and other high-speed signature transport devices.

BACKGROUND

Gathering devices such as perfect binders, saddle stitchers and mailroom inserters may use hoppers or feeders to collect sheet material. A saddle stitcher or perfect binder may for example collect folded printed materials fed from hoppers or feeders onto a saddle or perfect binder conveyor, respectively, to form a magazine or other printed product.

A saddle stitcher may collate signatures to assemble complete sets of signatures and bind them together using stitches. The signatures are opened to the centerfold and collated by feeding mechanisms onto a saddle raceway to be conveyed past a stitching mechanism. These bound signatures, or books, are then removed from the saddle conveyor for further processing, such as trimming the unbound edges.

U.S. Patent Application No. 2005/0225023 discloses a device for transporting printed products that permits removal of signatures from a saddle conveyor. A first conveyor moves a plurality of folded signatures in a first direction and a second conveyor includes a rotating blade device for lifting a signature from the first conveyor.

U.S. Pat. No. 4,260,145 discloses a tucker blade mechanism that contacts the folded edge of the signature from below the saddle conveyor. The tucker blade mechanism moves the signature forwardly and upwardly from the saddle conveyor as it moves in a vertical plane through a path, which is oblique relative to the saddle conveyor.

U.S. Pat. No. 4,482,141 discloses a method and device for conveying signatures from a blade chain conveyor supporting the signatures directly at a fold line. The signatures are gripped from above by orbitally-rotating clamping pads, which then transfer the signatures to a belt conveyor perpendicular to the blade chain conveyor.

U.S. Pat. No. 5,772,195 discloses a gathering and wire stitching machine for producing magazines, booklets and similar products from folded printed sheets comprising a conveyor path including a gathering segment and an adjoining wire stitching segment, the conveyor path including a saddle-shaped support for receiving printed sheets in a straddling arrangement from feeders arranged along the gathering segment.

BRIEF SUMMARY OF THE INVENTION

Problems arise when transporting signatures on high speed conveying devices like saddle conveyors. Corners of signatures may turn up forming "dog ears" as known in the art. Rectangular and round bar guides are used to keep the edges of the signatures down during transport. Existing signature guides do not have the flexibility to control adequately paper on a saddle raceway. Rigid guides cannot follow three-dimensional contours, are difficult to adjust and tend to bind up. Jams are also difficult to clear when using a rigid guide system.

Traditional brass guides are difficult to conform to transition areas. The brass requires bending with pipe wrenches and then running string. Brass guides are also not continuous, so there are many gaps along the raceway.

An object of the present invention is to provide better control of the signatures during transport on a saddle conveyor or other conveyors. A spool and spindle embodiment is advantageously adjustable in multiple axes and allows for contouring in transition areas in order to improve book or signature control along the raceway. The string system provides for continuous guiding and support along the raceway.

The present invention provides a signature guide including at least one flexible member and a plurality of supports. The flexible member is supported by the supports to define a guide area.

The present invention also provides a saddle stitcher. The saddle stitcher includes a saddle conveyor for transporting signatures and at least one signature guide located along the saddle conveyor. The signature guide includes a plurality of supports and at least one flexible member supported by the plurality of supports thereby defining a guide area. The at least one flexible member guides the signature in the guide area.

At least one of the supports preferably is a spindle tensioner tensioning the flexible member. At least one of the supports may include a spool over which the flexible member passes. The spool may be eccentric, so that rotation of the spool can alter the position of the flexible member.

The supports preferably have six degrees of freedom to allow for contouring the flexible member to raceways or conveyors over which the signatures are guided. The flexible member may include a plurality of round cross-sectioned flexible members, for example strings.

The saddle stitcher of the present invention also may further include a hopper area delivering signatures to the saddle conveyor to form gathered products, a stitching area for stitching the gathered products and a transition area downstream of the stitching area where the stitched products leave the saddle-back conveyor.

The present invention also provides a method for guiding signatures along a conveyor by contacting the signatures with the signature guide according to the present invention.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Figure 1:
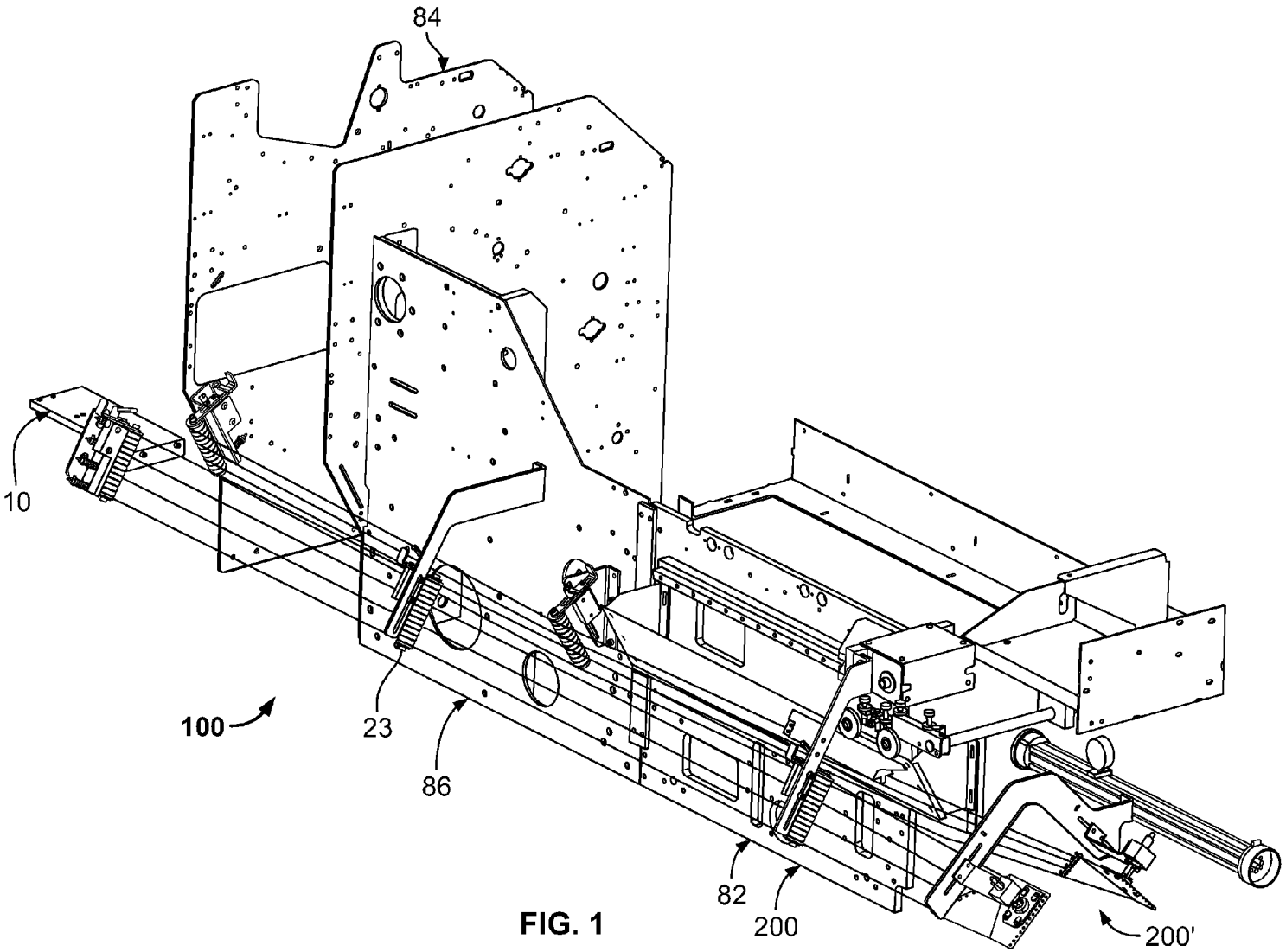
FIGS. 1 to 4 shows a stitcher delivery area on a saddle stitcher including the spool and spindle guide system in accordance with the present invention.

FIG. 1 shows a stitcher delivery area on a raceway or saddle stitcher 100 including the spool and spindle guide system 200, 200' according to the present invention. The saddle stitcher 100 includes a support frame 86 stitcher framer 82, a saddle conveyor 80 (FIG. 4) for transporting products, such as sheets, books or signatures and a delivery 84, for example, a hopper, depositing signatures on saddle back conveyor 80.

Figure 3:
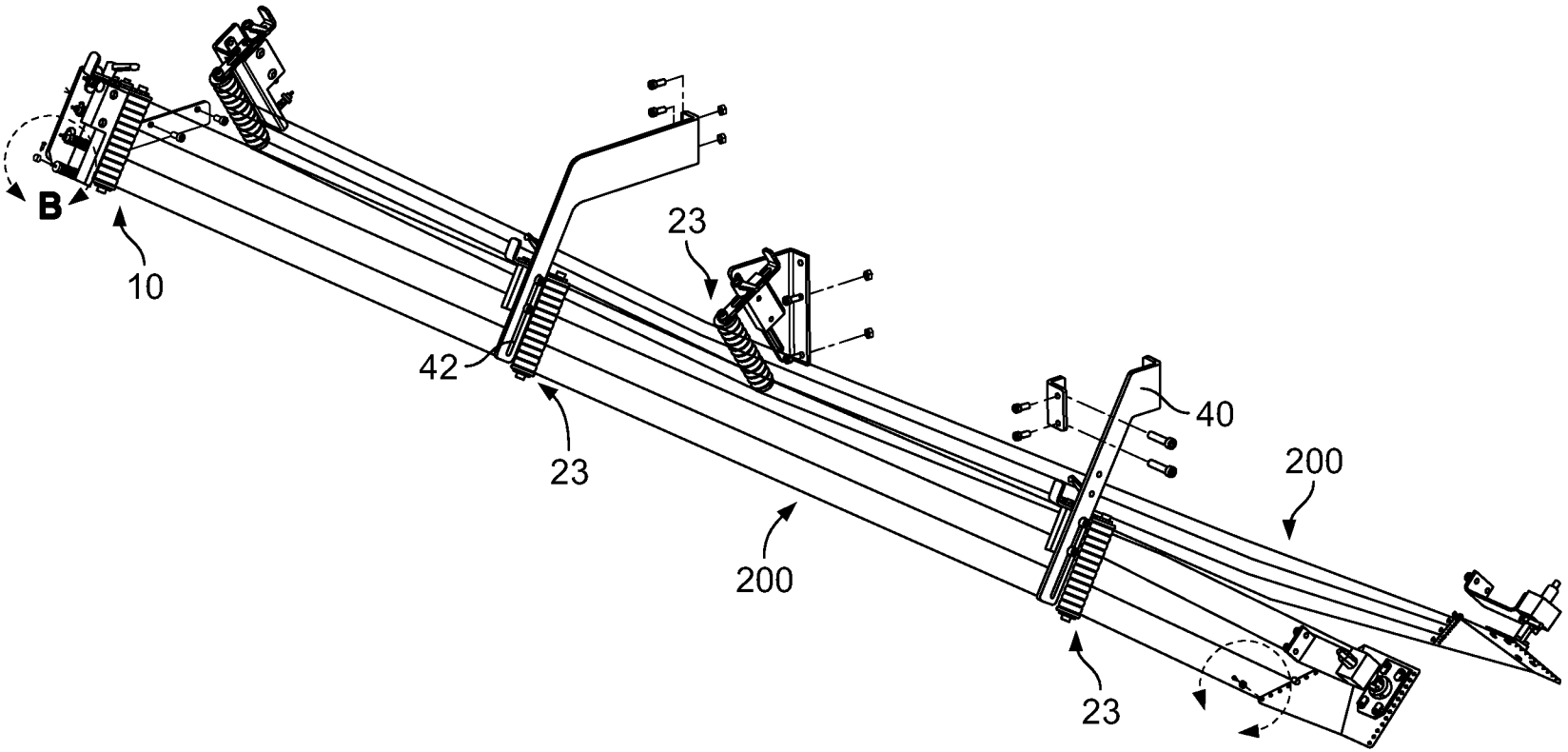
Figure 4:
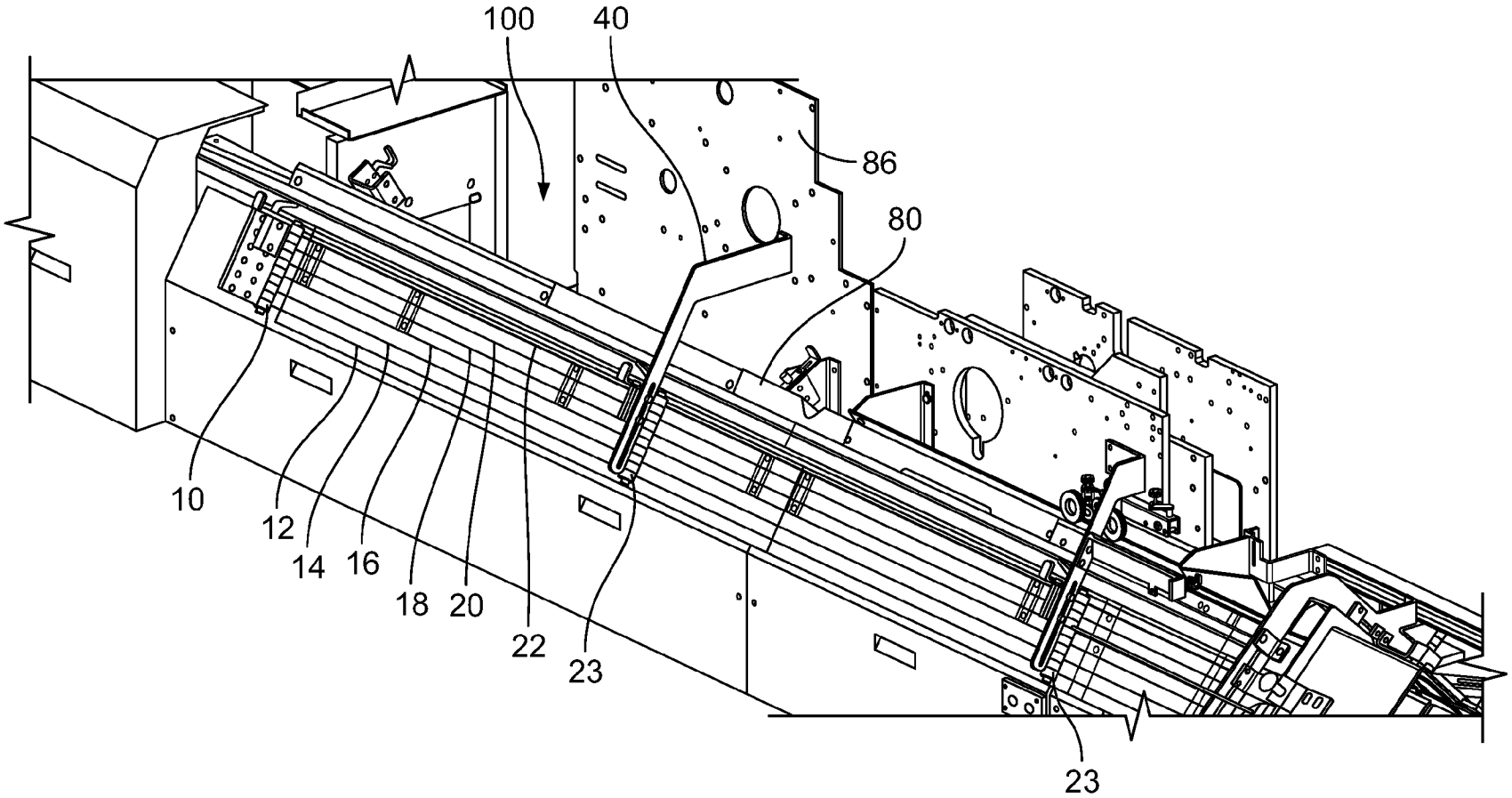

The spool and spindle guide system 200 includes a plurality of supports 10, 23 supporting a plurality of flexible members 12, 14, 16, 18, 20, 22 thereon. The supports include spring tensioners 10 and spools 23. As shown in FIGS. 1, 3 and 4 spindle tensioner 10 is located at one end of the spool and spindle guide system 200, for example, at the upstream end of system 200 with respect to saddle conveyor 100. Spool guides 23 are provided along the length of conveyor 100 and provide additional support for flexible members. Optionally, a second spindle tensioner 10 may be provided at the downstream end of conveyor 100 as well. The flexible members 12, 14, 16, 18, 20, 22, for example, strings, are supported at the upstream end by spring tensioner 10 and may be fixed or adjustably fixed at the other end by a further support which may include a second spindle tensioner 10 or, for example, an end plate 36 (FIG. 2).

Figure 2:
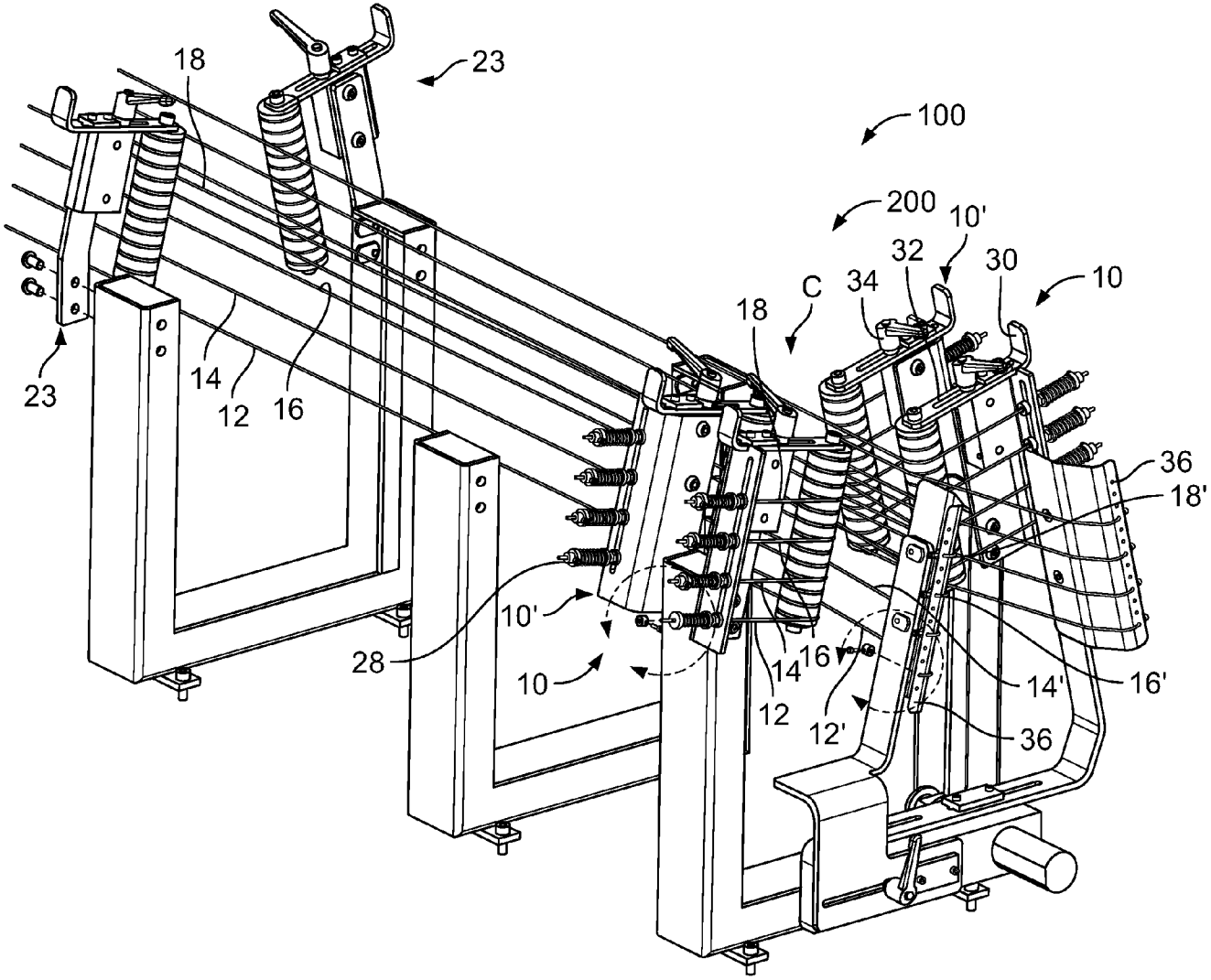
Figure 5:
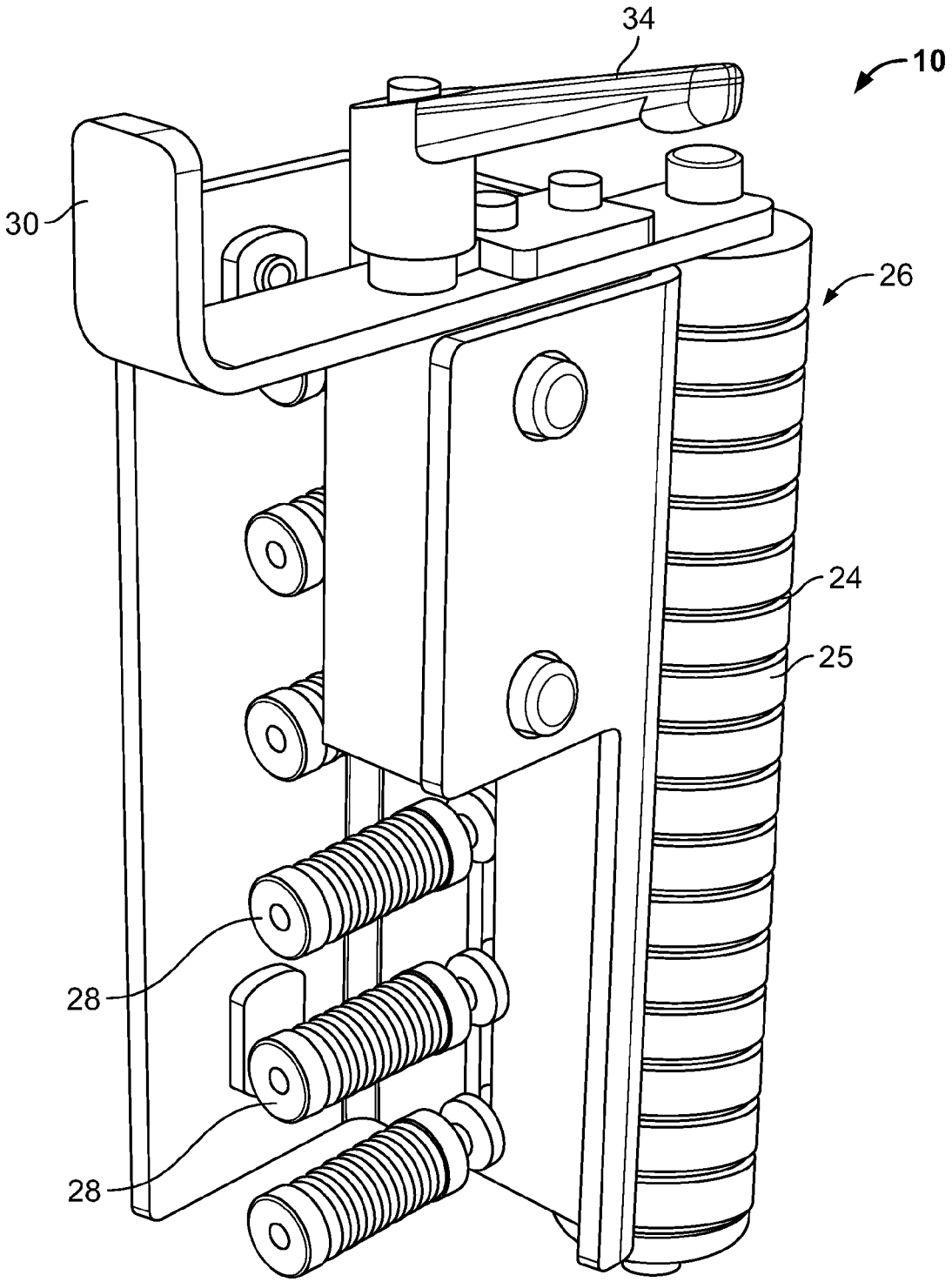
FIG. 5 shows a spring loaded spindle in accordance with a preferred embodiment of the present invention.

FIGS. 2 and 5 show the spindle tensioner 10 in accordance with a preferred embodiment of the present invention. Spindle tensioner 10 is a spring-loaded spool. Spindle tensioner 10 includes a spool 26 and a plurality of spring-loaded spindles 28. Spool 26 includes segments 25 separated by grooves 24. Grooves 24 receive strings 12, 14, 16, 18, 20, 22. Grooves 24 may be spaced between segments 25 along spool 26 as desired. Grooves 24 may be as small as a thickness of strings 12, 14, 16, 18, 20, 22 or larger to accommodate multiple thickness strings or allow for some play of the string 12 within groove 24. The height of segments 25 and thickness of grooves 24 are adjustable as desired. Spindles 28 apply tension to strings 12, 14, 16, 18, 20, 22 supported by spool 26.

Spindle tensioners 10 are attached to brackets 30 for positioning the spindle tensioners 10 adjacent saddle conveyor 80. Brackets 30 may include a slot 32 and fixing member 34 so spindle tensioner 10 is adjustably positioned toward or away from saddle conveyor 80 as desired. As such, the spindle tensioners are positioned vertically with respect to conveyor 80, horizontally with respect to conveyor 80 and toward or away from conveyor 80.

An operator can tighten spindles 28 to accommodate for creep and wear of the strings 12, 14, 16, 18, 20, 22 over time and use. In addition, strings 12, 14, 16, 18, 20, 22 can be loosed, tightened or adjusted as need to accommodate the products being transported on conveyor 80 and/or a surface or geometry of saddle back conveyor 80.

FIG. 2 shows an arrangement that may be used in a hopper delivery area. In this arrangement, flexible members mounted in different spindle tensioners 10 are interlaced with one another for a length along conveyor 100. As shown, strings 12', 14', 16', 18' are mounted to an end plate 36 on one end and to spindle tensioner 10' on the other end. Strings 12, 14, 16, 18 are mounted to spindle tensioner 10 on one end and continue downstream past spool 23. In the area C between spindle tensioner 10 and 10', strings 12, 14, 16, 18 are interlaced with strings 12', 14', 16', 18. The strings weave through each other so the transition from one section to the next is contiguous.

Spool and spindle guide system 200 also includes an adjustable lead in for products because the position of end plates 36 and strings, 12, 14, 16, 18, 12', 14', 16', 18 are adjustable. End plates can be moved toward or away from conveyor 100 to change the geometry of the transition area from the hopper. End plates 36 and strings, 12, 14, 16, 18, 12', 14', 16', 18 are articulated to provide a funnel for products moving down the saddle conveyor 80. The product makeup including page number, width, length, stock thickness etc., affects the amount of constraint the "funnel" or lead in is set to. A shallower angle provides more constraint.

Figure 6:
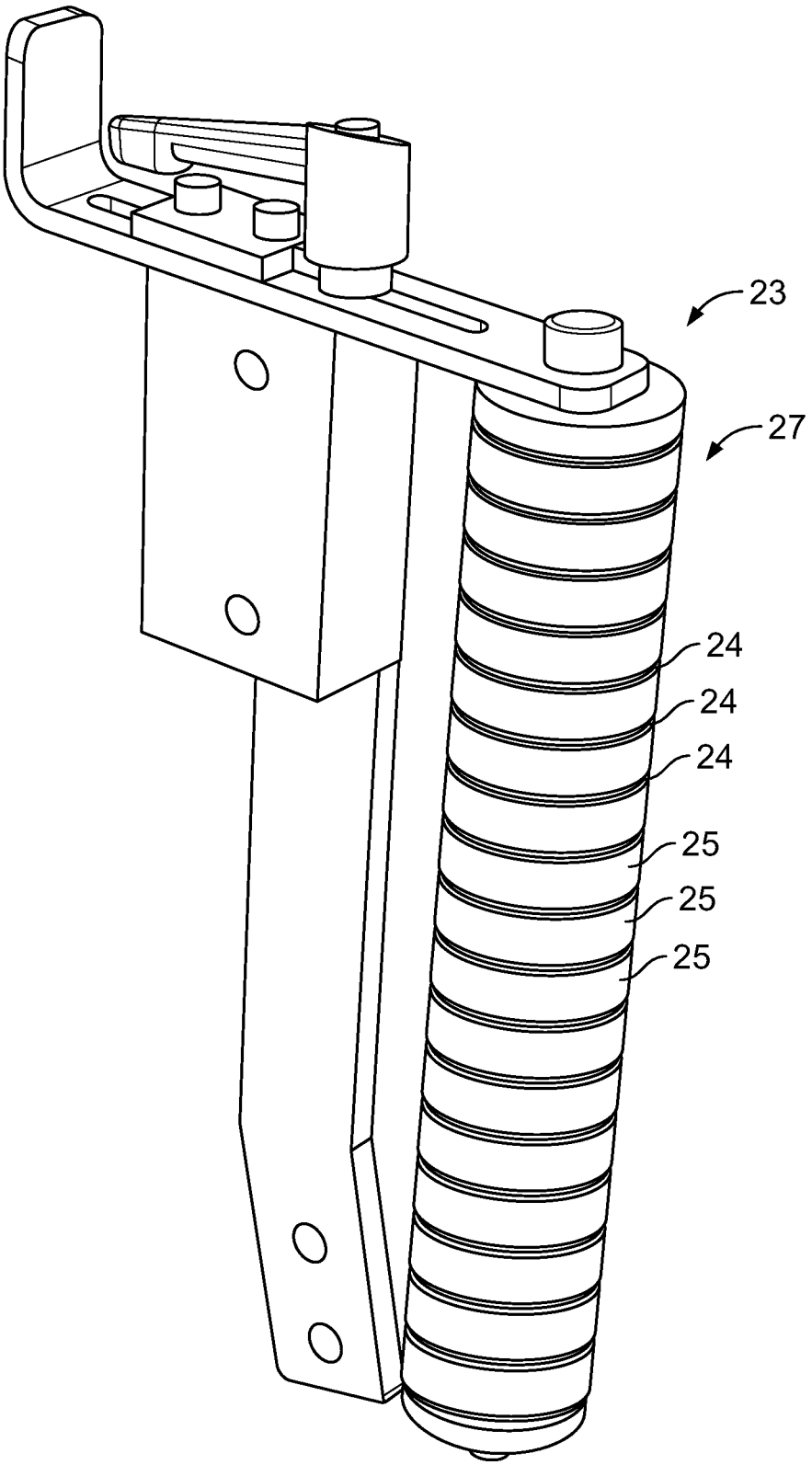
FIG. 6 shows a spool in accordance with a preferred embodiment of the present invention.

FIGS. 3 and 6 show signatures guides 200, 200' on opposing sides of the saddle conveyor (not shown for clarity.) having spool guides 23 in accordance with a preferred embodiment of the present invention. Similar to spindle tensioner 10, spool guide 23 includes a spool 27 having segments 25 separated by grooves 24. Strings 12, 14, 16, 18, 20, 22 are supported via grooves 24. Grooves 24 may be spaced between segments 25 along spool 26 as desired. Grooves 24 may be as small as a thickness of strings 12, 14, 16, 18, 20, 22 or larger to accommodate multiple thickness strings or allow for some play of strings 12, 14, 16, 18, 20, 22 within groove 24. The height of segments 25 and thickness of grooves 24 may be adjusted as desired. A plurality of spool guides 23 may be provided between the spindle tensioner 10 and end support along a length of saddle raceway 100. Spool guides 23 may be used to bend or contour strings 12, 14, 16, 18, 20, 22 to the products being transported at high speeds down the saddle stitcher 100. Brackets 40 are used to support spool guides 23 with respect to saddle conveyor 80. Brackets 40 may be connected to a support frame 86 or stitcher frame 82, for example. As shown in FIG. 3, brackets 40 may include slots 42 so spool guides can be adjustably positioned with respect to the saddle conveyor 80 as desired. As such, the spool guides can be positioned vertically with respect to conveyor 80, horizontally with respect to conveyor 80 and toward or away from conveyor 80.

Figure 7:
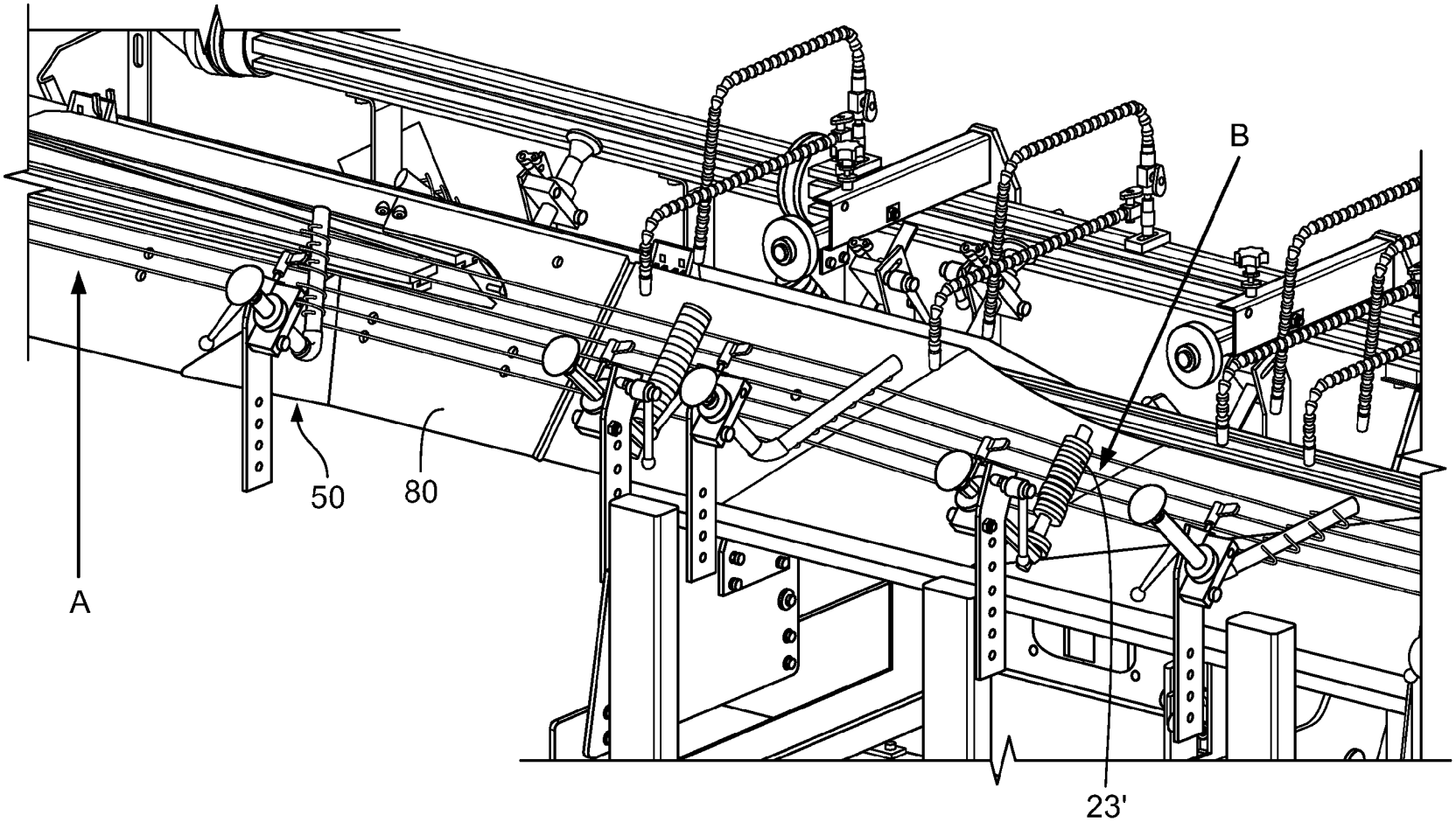
FIGS. 7 and 8 show the spool and spindle guide in a transition area.
Figure 8:
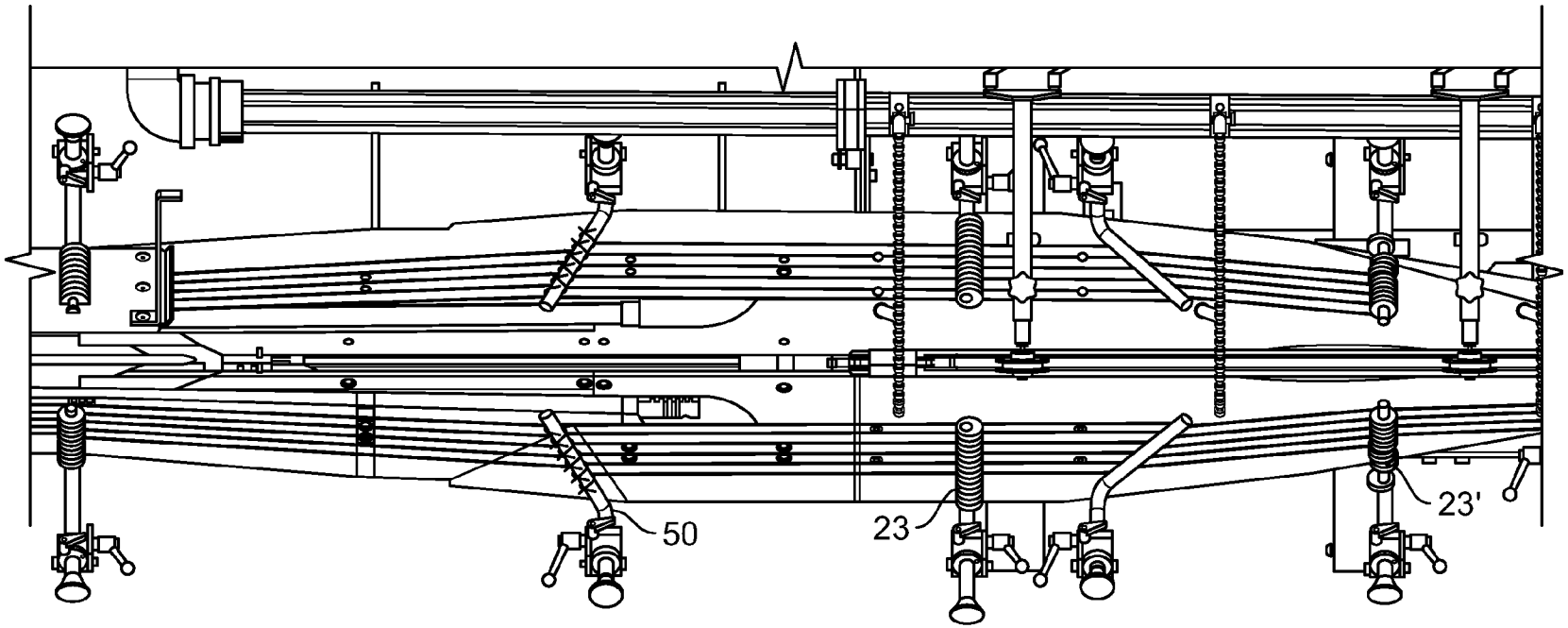

FIGS. 7 and 8 show the spool guides 23 in transition areas A, B; where the products move from a saddle position in area A to a flat position in area B. The spool guides 23 can be angled and adjusted to move the strings 12, 14, 16, 18, 20, 22 to conform to the complex shape of the transition area. The spool guides 23 may include eccentric spool sections 25 so as to further conform strings 12, 14, 16, 18, 20, 22 to the slopes of saddle conveyor 100 or products, see for example, spool guide 23'. The segments 25 of spool guide 23' are laterally displaced from one another to conform to the vertical slope of conveyor 80.

In addition, bowing rods 30 may be provided along the length of saddle conveyor 80 to further contour strings 12, 14, 16, 18, 20, 22 to the complex shape of the transition areas A, B. Bowing rods 30 may press, direct or guide to further customize and accommodate the transportation of products along the conveyor 100. For example, bowing guides are used to give a concave shape to the strings 12, 14, 16, 18, 20, 22 in relation to the saddle conveyor 100.

The spool and spindle guide system 200 provides a flexible and adjustable support system for products being transported on saddle stitcher 100. The flexible members or strings can, by virtue of the spindle tensioners 10 and spool guides 23 having six degrees of separation, be contoured to the saddle back conveyor 80 and sloped sides in this area. As a result, the spool and spindle guide system 200 can be tailored to the product being transported as described above. Multiple spool and spindle guide systems 200 may be provided along the saddle conveyor and on both sides of the saddle conveyor. Some guide systems may be consecutive along the length of the conveyor, for example, upstream or downstream from each other. Other guide systems 200 may overlap to provide smooth transition areas. In the past, accommodating the transition areas with brass bars was difficult. Many of the drawbacks previously associated therewith have been eliminated with the flexibility and adjustability of the spool and spindle guide system 200.

Further advantages of a spool and spindle guide in accordance with an embodiment of the present invention include the ease of making adjustments. Vertical adjustments do not need to be made and angular adjustments may be made via a pivot. Adjustments towards and away from the raceway may be made with a hexagonal shaft, to prevent spool rotation, a round shaft that allows the spindly to rotate or a slot and pin which prevents rotation. The adjustments are smoother than in those in the current state of the art.

Another advantage is the reduction in make ready time with the spool and spindle embodiment of the present invention. The string can accommodate multiple product sizes without having to make adjustments. There is also a cost savings associated with the spool and spindle embodiment. The cost may be 8 times less than traditional guide systems, for example.

Using the spool and spindle embodiment of the present invention provides for flexibility through the caliper, long book area and hopper. Traditionally, guides were not adjustable so guides could not be used in the hopper area. Air blasts were used instead. The air blasts were difficult and timely to adjust. The air blasts also caused disturbances in the drop area. The spool and spindle system is easily adjustable and can be used in the hopper area thereby eliminating the use of air blasts and the problems associated therewith.

A further advantage of the spool and spindle guide is the interchangeability and commonality of parts. Traditional brass guides were specifically designed for particular areas along the raceway. Approximately 90% of the spool and spindle guide system includes common parts.

The flexible member, which may have a round cross-section in a preferred embodiment, can be any shape. The flexible member can wrap around spindles that include six degrees of freedom to allow for contouring the guiding to the raceway of the saddle stitcher/conveyor. The spool and spindle embodiment allows contouring to the behavior of the books or signatures as they are transported at high speeds down the saddle raceway. Multiple guides may be added easily to the system based on the pitch of the grooves in the spools which may be as small as the thickness of the flexible member. The flexible members can be tensioned with springs to allow for creep and wear over time.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A saddle stitcher comprising:
a saddle conveyor for transporting signatures; and
at least one signature guide located along the saddle conveyor comprising:
a plurality of supports; and
at least one flexible member, the flexible member being supported by the plurality of supports to define a guide area;
the at least one flexible member for guiding the signature in the guide area.

2. The saddle stitcher as recited in claim 1 wherein at least one of the plurality of supports includes an adjustable tensioner to tension the flexible member.

3. The saddle stitcher as recited in claim 1 wherein the adjustable tensioner is a spindle.

4. The saddle stitcher as recited in claim 1 wherein at least one of the plurality of supports includes a spool over which the flexible member passes.

5. The saddle stitcher as recited in claim 4 wherein the spool includes eccentric segments so rotation of the spool alters a position of the flexible member.

6. The saddle stitcher as recited in claim 1 wherein at least one of the plurality of supports has six degrees of freedom to allow for contouring the flexible members in the guide area.

7. The saddle stitcher as recited in claim 1 wherein the at least one flexible member includes a plurality of flexible members.

8. The saddle stitcher as recited in claim 1 further comprising a further signature guide located along the conveyor.

9. The saddle stitcher as recited in claim 8 wherein the at least one flexible member of the further signature guide is interlaced with the at least one flexible member of the signature guide.

10. The saddle stitcher as recited in claim 8 wherein the further signature guide and signature guide are on located opposite sides of the saddle conveyor.

11. The saddle stitcher as recited in claim 1 wherein the signature guide includes a bowing rod to further contour a shape of the at least one flexible member.

12. The saddle stichter as recited in claim 1 wherein the plurality of supports includes an end plate.

13. The saddle stichter as recited in claim 1 wherein the at least one signature guide is arranged along the saddle conveyor to form a funnel for receiving signatures in a transition area.

14. A method for guiding signatures comprising:
guiding signatures along a conveyor by contacting the signatures with the signature guide recited in claim 1.

15. The method as recited in claim 14 further comprising the step of:
adjusting one of the plurality of supports to conform the at least one flexible member to a contour of the saddle conveyor.

16. A method for guiding signatures comprising:
transporting signatures on a saddle conveyor;
providing a plurality of supports along a length of the conveyor;
supporting at least one flexible member between the plurality of supports thereby defining a guide area;
guiding the signatures with the at least one flexible member in the guide area.

17. The method as recited in claim 16, wherein the at least one flexible member contacts the signatures in the guide area.

18. The method as recited in claim 16, wherein the plurality of supports includes at least one spool over which the at least one flexible member passes.

19. The method as recited in claim 16 further comprising the step of:
adjusting one of the plurality of supports to conform the at least one flexible member to a contour of the saddle conveyor.

20. The method as recited in claim 16 further comprising the step of:
adjusting the tension of the at least one flexible member.

* * * * *